US008360998B2

(12) United States Patent
Apodaca et al.

(10) Patent No.: US 8,360,998 B2
(45) Date of Patent: Jan. 29, 2013

(54) APPLICATOR SYSTEM WITH VIBRATING IMPLEMENT

(75) Inventors: Adrian C. Apodaca, Santa Monica, CA (US); Timothy Thorpe, Santa Monica, CA (US); Christopher Thorpe, Bridgewater, NJ (US)

(73) Assignee: HCT Asia Ltd., Central (HK)

( * ) Notice: Subject to any disclaimer, the term of this patent is extended or adjusted under 35 U.S.C. 154(b) by 398 days.

(21) Appl. No.: 12/698,875

(22) Filed: Feb. 2, 2010

(65) Prior Publication Data

US 2011/0190672 A1 Aug. 4, 2011

(51) Int. Cl.
*A61H 1/00* (2006.01)

(52) U.S. Cl. ..... 601/17; 601/18

(58) Field of Classification Search ..... 15/22.1, 15/22.2, 379; 118/57; 132/218, 320; 401/129, 401/183; 601/17, 18; 222/198
See application file for complete search history.

(56) References Cited

U.S. PATENT DOCUMENTS

| | | | | |
|---|---|---|---|---|
| 4,291,685 | A * | 9/1981 | Taelman | 601/17 |
| 6,139,553 | A * | 10/2000 | Dotan | 606/131 |
| 7,282,037 | B2 * | 10/2007 | Cho | 601/80 |
| 7,638,144 | B2 * | 12/2009 | Rhaodes | 424/691 |
| 7,927,032 | B2 * | 4/2011 | Sanchez | 401/129 |
| 8,028,707 | B2 * | 10/2011 | Wyatt et al. | 132/218 |
| 2004/0034315 | A1 * | 2/2004 | Chen | 601/72 |
| 2004/0249320 | A1 * | 12/2004 | Yamazaki et al. | 601/46 |
| 2005/0268409 | A1 * | 12/2005 | Blaustein et al. | 15/22.1 |
| 2006/0032512 | A1 * | 2/2006 | Kress et al. | 132/218 |
| 2006/0216104 | A1 * | 9/2006 | Bouix et al. | 401/270 |
| 2007/0186951 | A1 * | 8/2007 | Gueret | 132/320 |
| 2008/0138138 | A1 * | 6/2008 | Gueret | 401/24 |
| 2010/0300474 | A1 * | 12/2010 | Tsai | 132/218 |
| 2012/0065555 | A1 * | 3/2012 | Chae et al. | 601/18 |

* cited by examiner

*Primary Examiner* — Nicholas Lucchesi
*Assistant Examiner* — Gerald Landry, II
(74) *Attorney, Agent, or Firm* — Lee & Hayes, PLLC

(57) ABSTRACT

An applicator system for providing a massaging and a cooling effect while applying product to a body includes an applicator tip connected to a vibrating mechanism that is disposed proximate to the applicator storage tip. By virtue of having the vibrating mechanism disposed proximate to the applicator tip, the vibration produced by the vibrating mechanism is transferred primarily to the applicator tip.

23 Claims, 8 Drawing Sheets

APPLICATOR SYSTEM WITH VIBRATING IMPLEMENT

BACKGROUND

Devices exist for applying cosmetic or medicinal products to a body. Existing applicators are typically designed to apply product to a body to achieve a single desired effect. For example, one applicator may be a vibrating applicator designed to provide a massaging effect, while a second applicator may be a steel tipped applicator designed to provide a cooling effect. Such devices usually consist of an outer tubular shell or housing, a delivery mechanism for displacement of the cosmetic or medicinal products, and an applicator tip.

Thus, existing applicators have limited functionality, and are not conducive to providing multiple desired effects to the body. Accordingly, there remains a need in the art for improved applicator systems that provide multiple desired effects while applying product to a body.

BRIEF DESCRIPTION OF THE DRAWINGS

The detailed description is set forth with reference to the accompanying figures. In the figures, the left-most digit(s) of a reference number identifies the figure in which the reference number first appears. The use of the same reference numbers in different figures indicates similar or identical items.

DETAILED DESCRIPTION

Overview

Figure 1:
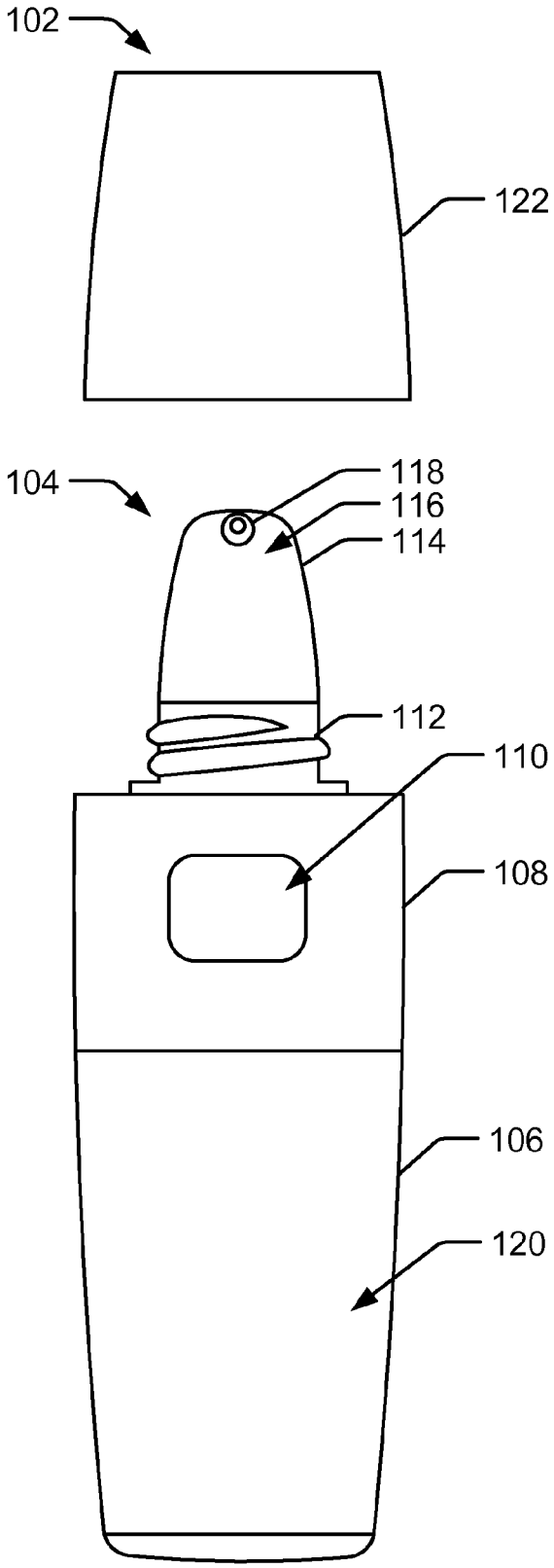
FIG. 1 depicts an illustrative applicator system for applying a product to a surface.

This application describes applicator systems that may provide a massaging effect alone or in combination with a cooling effect while applying product to a body. In addition to the capacity to provide multiple desired effects, the applicator systems may also provide the convenience of dispensing product utilizing a combination of a flexible walled housing and a through-hole tip. In some examples, the applicator systems comprise a thermal storage tip disposed proximate to, and substantially coupled with, a vibrating mechanism. When included, the thermal storage tip coupled to the vibrating mechanism may have an application surface comprising various metals, ceramics, composites, and/or other materials that can be heated or cooled and are able to store and maintain a level of thermal energy. In some examples, the vibrating mechanism may be selectively switched on, activating the vibrating mechanism coupled to the thermal storage tip. Likewise, the vibrating mechanism may also be selectively switched off, deactivating the vibrating mechanism coupled to the thermal storage tip. In another example, the applicator systems may comprise a cut-off switch electrically coupled to the selective switch for deactivating the selective switch when the applicator system is not in use, and keeping the vibrating mechanism from being inadvertently switched on. In some implementations, a through-hole may fluidly connect the thermal storage tip with a flexible walled housing. Devices according to this disclosure are capable of applying cosmetic, medicinal, and/or personal care products to a body while providing multiple desired effects.

Generally, an applicator system according to this disclosure comprises a housing having a reservoir, a collar having a vibrating mechanism, and a thermal storage tip disposed proximate to and coupled with the vibrating mechanism disposed in the collar. The housing has a flexible wall that is displaceable for dispensing a product contained in the reservoir. The reservoir may include a delivery tube that extends longitudinally from the reservoir to the thermal storage tip. The vibrating mechanism generally includes a floating chassis, which houses an electrically coupled motor, battery, and on/off switch. In addition to the vibrating mechanism, the applicator system according to this disclosure may also include a cut-off switch disposed in a fastening portion of the collar and electrically coupled with the on/off switch. Here, the cut-off switch may be for deactivating the on/off switch and preventing power from being supplied to the motor when a cap is threaded on the extended fastening portion of the collar, encapsulating the thermal storage tip.

In various embodiments, the applicator systems described herein may include a vibrating mechanism movably housed in the extended fastening portion of the collar or in the thermal storage tip. Also, the on/off switch may comprise a button, a lever or switch-type actuator and may be disposed in the extended fastening portion of the collar, in a main body portion of the collar, or in the housing.

The cap may be removably coupled to the extended fastening portion of the collar by a variety of attachment means, such as by snap fit, by screw threads, by a twist lock mechanism, by magnetic force, by interference fit, combinations of any of the foregoing, or the like.

Illustrative Applicator System with Vibrating Implement

FIG. 1 depicts an illustrative applicator system 102 for applying a product to a surface. The applicator system 102 includes a vibrating implement 104, and a housing 106 comprising a reservoir (not shown) for containing a cosmetic, medicinal, personal care, or other product. In the illustrated embodiment, the vibrating implement 104 comprises a collar 108 disposed on the housing 106. Collar 108 may be comprised of plastic, metal, ceramic or any other suitable material. For example, collar 108 may be comprised of terpolymer, polypropylene (PP), acrylonitrile butadiene styrene (ABS) or Polyoxymethylene (POM). In the illustrated embodiment shown in FIG. 1 an on/off push button switch 110 is disposed in collar 108 for activating/deactivating the vibrating implement 104. A protruding fastening portion 112 is disposed on top of collar 108. On a top portion of protruding fastening portion 112 is disposed a thermal storage tip 114. The thermal storage tip 114 comprises a conical body having a convex surface formed therein and an application surface comprising various metals, ceramics, composites, and/or other materials that can be heated or cooled and are able to store and maintain a level of thermal energy. In some embodiments, thermal storage tip 114 may comprise a metal such as stainless steel, anodized aluminum, brass, a ceramic, a high-density plastic, or any other suitable material for conducting heat to a body. In this illustrated implementation, the convex surface formed in the conical body of thermal storage tip 114 defines an application face 116, in which, a tip insert 118 is shown to be terminating. Tip insert 118 may provide a through-hole interconnection of application face 116 to a reservoir (again not shown) of housing 106. In this illustrated implementation, housing 106 comprises a flexible wall 120 configured to displace some portion of the product stored in the housing 106 onto application face 116. While FIG. 1 illustrates housing 106 having a flexible wall 120, a housing having two flexible walls is also contemplated. Furthermore, housings having rigid walls are also possible if other means of dispensing the product are cited (e.g., pump, piston, etc.). Housing 106 may be comprised of plastic, metal, ceramic or any other suitable material. For example, housing 106 may be comprised of terpolymer, polypropylene (PP), acrylonitrile butadiene styrene (ABS) or Polyoxymethylene (POM). In the example shown, flexible wall 120 may be comprised of plastic. For example, a translucent, tinted or opaque terpolymer or any other suitable plastic material for flexing and which is non-reactive or resistant to the product being dispensed may be used.

The applicator system 102 also includes a cap 122 that fastens to protruding fastening portion 112, encapsulating the thermal storage tip 114 when in non-use. The cap 122 may be made of a thermoplastic polymer or any other material which is non-reactive or resistant to the product being dispensed, such as various metals, plastics, ceramics, composites, or the like. Also, and as discussed above, the cap 122 may be removably coupled to the protruding fastening portion 112 of the collar 108 by a variety of attachment means, such as by snap fit, by screw threads, by a twist lock mechanism, by magnetic force, by interference fit, combinations of any of the foregoing, or the like.

As illustrated, housing 106 and collar 108 may generally be tube-shaped. While housing 106 and collar 108 generally form a tube-shape, other shapes such as box-shaped, purse-shaped, shell-shaped or the like are conceptualized.

Figure 2B:
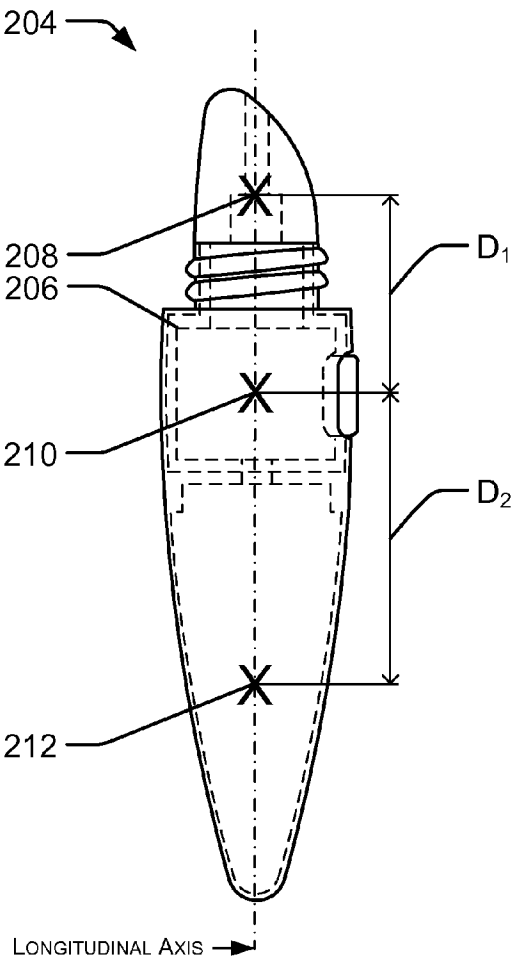
FIG. 2A and FIG. 2B illustrate a front view and side view of the vibrating implement shown in FIG. 1 and the location of the vibrating mechanism.
Figure 2A:
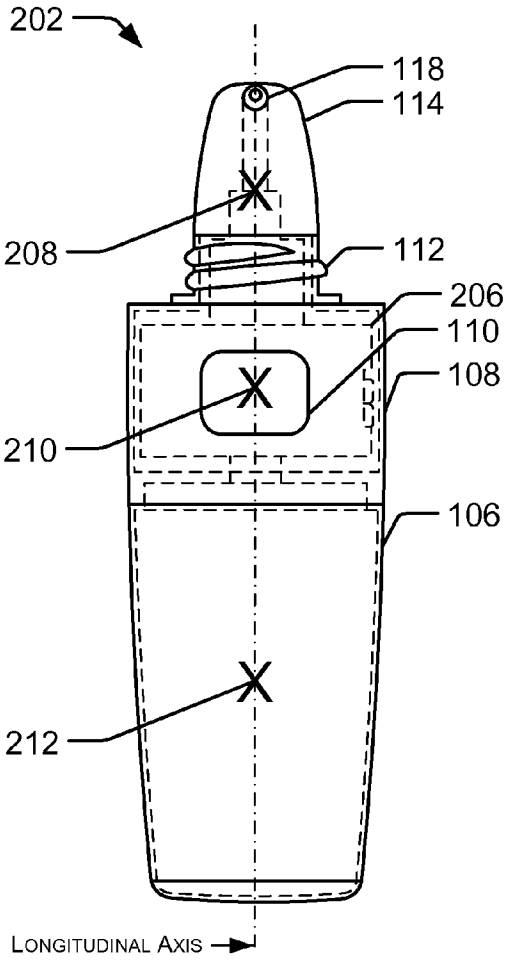

FIG. 2A illustrates a front view 202 of the vibrating implement 104 shown in FIG. 1. FIG. 2B illustrates a side view 204 of the vibrating implement 104 shown in FIG. 1. In this implementation, the vibrating implement 104 further comprises a vibrating mechanism 206 movably housed in collar 108. The vibrating implement 104 shown in FIG. 2A and FIG. 2B present some of the same components shown in FIG. 1 in greater detail. For instance, the vibrating implement 104 shown in FIG. 2A and FIG. 2B show housing 106, collar 108, on/off push button switch 110, protruding fastening portion 112, thermal storage tip 114, and tip insert 118. FIG. 2A and FIG. 2B further illustrate, a longitudinal axis of vibrating implement 104 in front view 202 and side view 204. Further, as illustrated in front view 202 and side view 204 of vibrating implement 104 are geometric centers 208, 210 and 212 disposed on the longitudinal axis. Specifically, geometric centers 208, 210 and 212 represent geometric longitudinal and latitudinal center marks of thermal storage tip 114, vibrating mechanism 206, and housing 106 respectively. Furthermore, and as illustrated in FIG. 2, thermal storage tip 114 is positioned proximate to vibrating mechanism 206. More specifically, thermal storage tip's 114 geometric center 208 is positioned closer to vibrating mechanism's 206 geometric center 210 than housing's 106 geometric center 212. This is in contrast with other vibrating applicator implements that comprise vibrating mechanisms disposed distal to the vibrating applicator tip (e.g., a vibrating mechanism being disposed at the center or closer to the bottom rather than the top of the vibrating applicator implement). FIG. 2A and FIG. 2B illustrate thermal storage tip's 114 geometric center 208 being positioned closer to vibrating mechanism's 206 geometric center 210 by the dimension lines D1 and D2. Here, D1 is the distance from the thermal storage tip's 114 geometric center 208 to vibrating mechanism's 206 geometric center 210, and D2 is the distance from housing's 106 geometric center 212 to vibrating mechanism's 206 geometric center 210. As shown in FIG. 2A and FIG. 2B, D2 is greater than D1. It should be appreciated, that because D2 is greater than D1 (i.e., thermal storage tip 114 is proximate to vibrating mechanism 206) the vibration produced by the vibrating mechanism 206 disposed proximate to thermal storage tip 114 experiences reduced vibration dampening effects as the vibration travels to the thermal storage tip 114. Thus, the vibration is able to be largely translated to the thermal storage tip 114, with minimal vibration being transmitted to a user's hand.

While vibrating mechanism 206 is illustrated as being movably housed by collar 108, other housing locations such as being housed in protruding fastening portion 112, being housed in thermal storage tip 114, or being disposed on an outside surface of vibrating implement 104 are also conceptualized.

Figure 3:
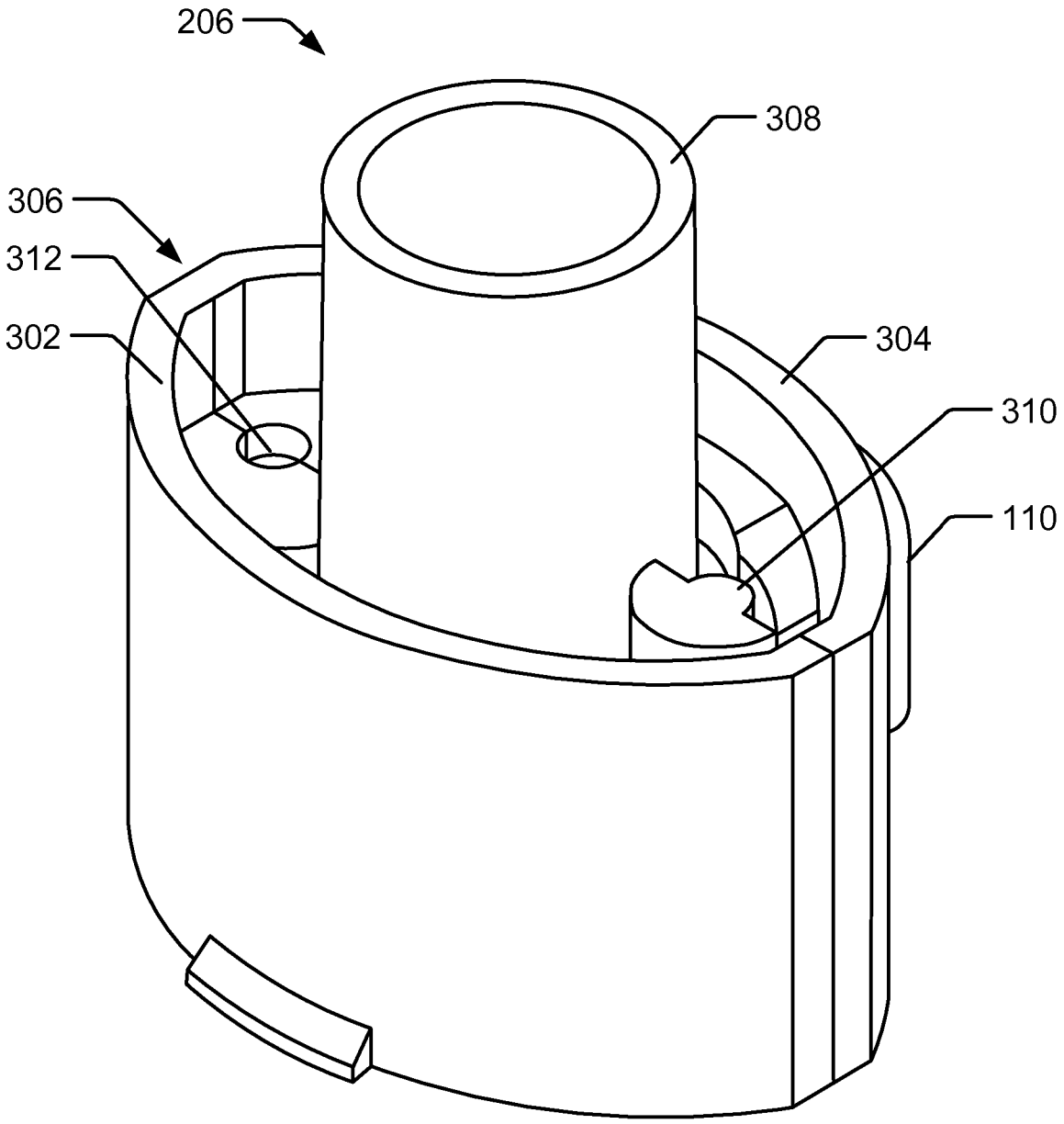
FIG. 3 depicts an illustrative vibrating mechanism movably housed by collar of vibrating implement of FIG. 1.

FIG. 3 depicts an illustrative vibrating mechanism 206 movably housed by collar 108 of vibrating implement 104 of FIG. 1. As discussed above, vibrating mechanism 206 comprises first half 302 sandwiched or mated together with second half 304, which when sandwiched together define floating chassis 306. The floating chassis 306 may be made of a thermoplastic polymer or any other material which is non-reactive or resistant to the product being dispensed, such as various metals, plastics, ceramics, composites, or the like. Here, first half 302 comprises a coupling 308, a vibration generator 310 and a battery 312. Meanwhile, second half 304 houses on/off push button switch 110 and provides for enclosing or sandwiching vibration generator 310 and battery 312 in-between first half 302 and second half 304. (Discussed in further detail below with respect to FIG. 4). While first half 302 is illustrated as comprising coupling 308, vibration generator 310, and battery 312, second half 304 could comprise these components instead. Likewise, while second half 304 is illustrated as housing on/off push button switch 110, first half 302 could comprise on/off push button switch 110 instead. Further, while FIG. 3 illustrates floating chassis 306 comprising first half 302 and second half 304, it is contemplated that floating chassis 306 may comprise a single member or any number of members.

Figure 4B:
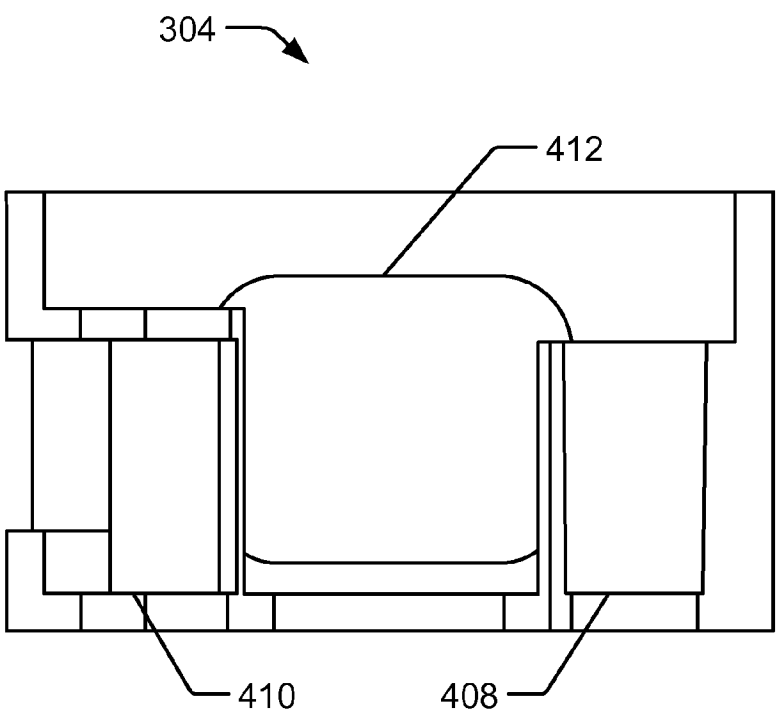
FIG. 4B depicts a second half, which when assemble comprise the vibrating mechanism of FIG. 3.
Figure 4A:
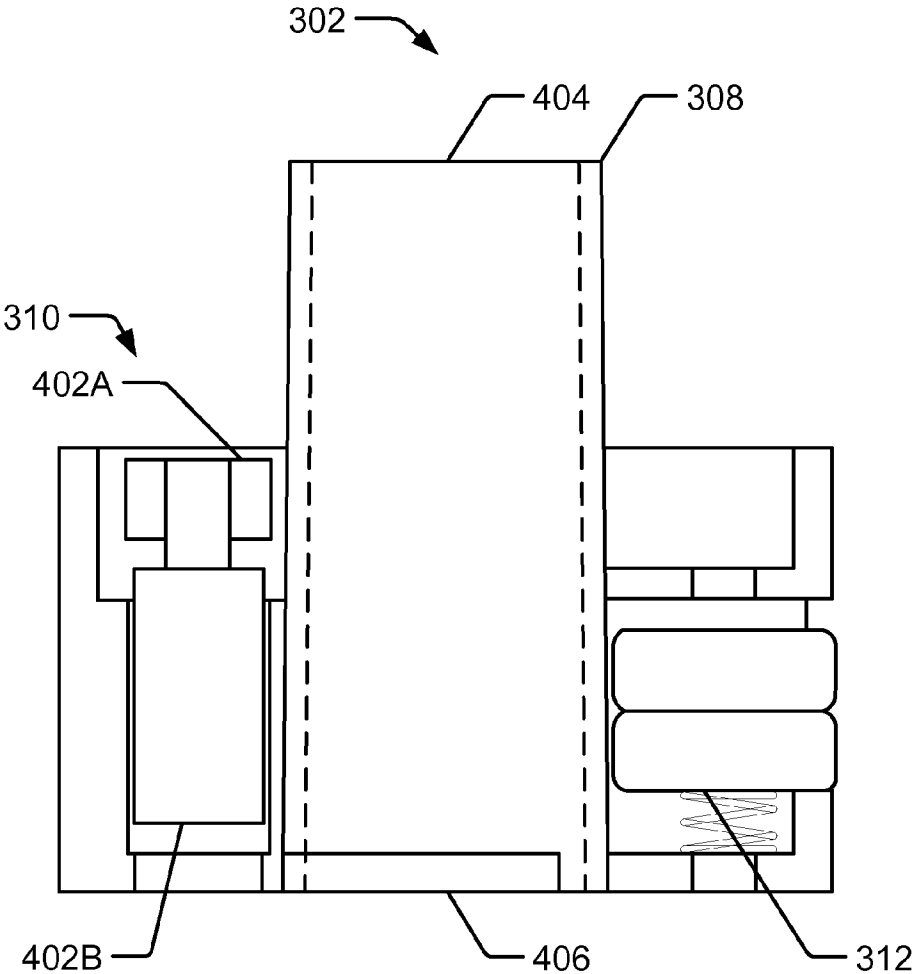
FIG. 4A depicts an illustrative first half.

FIG. 4A depicts an illustrative first half 302 and FIG. 4B depicts an illustrative second half 304, which when assemble, comprise the vibrating mechanism 206 of FIG. 2. Turning now to illustrated first half 302 of FIG. 4A, first half 302 illustrates vibration generator 310 comprising an unbalanced weight 402A rotatably attached to motor 402B. Here, the motor 402B is illustrated to be attached by an interference fit to first half 302 of vibrating mechanism 206. Further, when unbalanced weight 402A is spun by motor 402B a vibrating effect is produced, which is then transferred directly to first half 302 of vibrating mechanism 206. While the vibration generator 310 may be attached to first half 302 by way of an interference fit, a variety of attachment means are contemplated, such as by snap fit, by screw threads, by a twist lock mechanism, by magnetic force, combinations of any of the foregoing, or the like. Furthermore, while the vibration generator 310 is illustrated here as comprising an unbalanced weight 402A and an electric motor 402B, other vibration generating mechanisms are contemplated. For example, the vibration generator may comprise a coil spring mechanism attached to an unbalanced weight, where the coil spring may be wound by a winding mechanism (i.e., not an electric motor) or any other suitable means for spinning an unbalanced weight. The unbalanced weight 402A and motor 402B are illustrated to be generally disposed proximate to the outside diameter of coupling 308. FIG. 4A further illustrates a top coupling portion 404 and a bottom coupling portion 406 of coupling 308. Top coupling portion 404 is for connecting thermal storage tip 114 (discussed below in more detail) and bottom coupling portion 406 allows a fluid interconnection between housing 106 and tip insert 118 (also described below in more detail).

Turning now to illustrated second half 304 of FIG. 4, second half 304 illustrates a motor compartment 408, a battery compartment 410 and an aperture 412. As illustrated in FIG. 3, when first half 302 is mated/sandwiched to second half 304, motor 402B and battery 312 are sandwiched in-between first half 302 and second half 304. More specifically, a portion of motor 402B and a portion battery 312 are attached to first half 302 and the remaining protruding portions of motor 310 and battery 312 are encapsulated by motor compartment 408 and battery compartment 410 respectively, when first half 302 is sandwiched to second half 304. Specifically, with motor 402B substantially fixed between first half 302 and second half 304, the vibration produced by the vibration generator 310 (i.e., unbalanced weight 402A and motor 402B) is transferred directly to vibrating mechanism 206. Furthermore, and as illustrated in FIG. 3, aperture 412 disposed in second half 304 is configured to house on/off push button switch 110, which is electrically coupled to motor 402B and battery 312.

Figure 5:
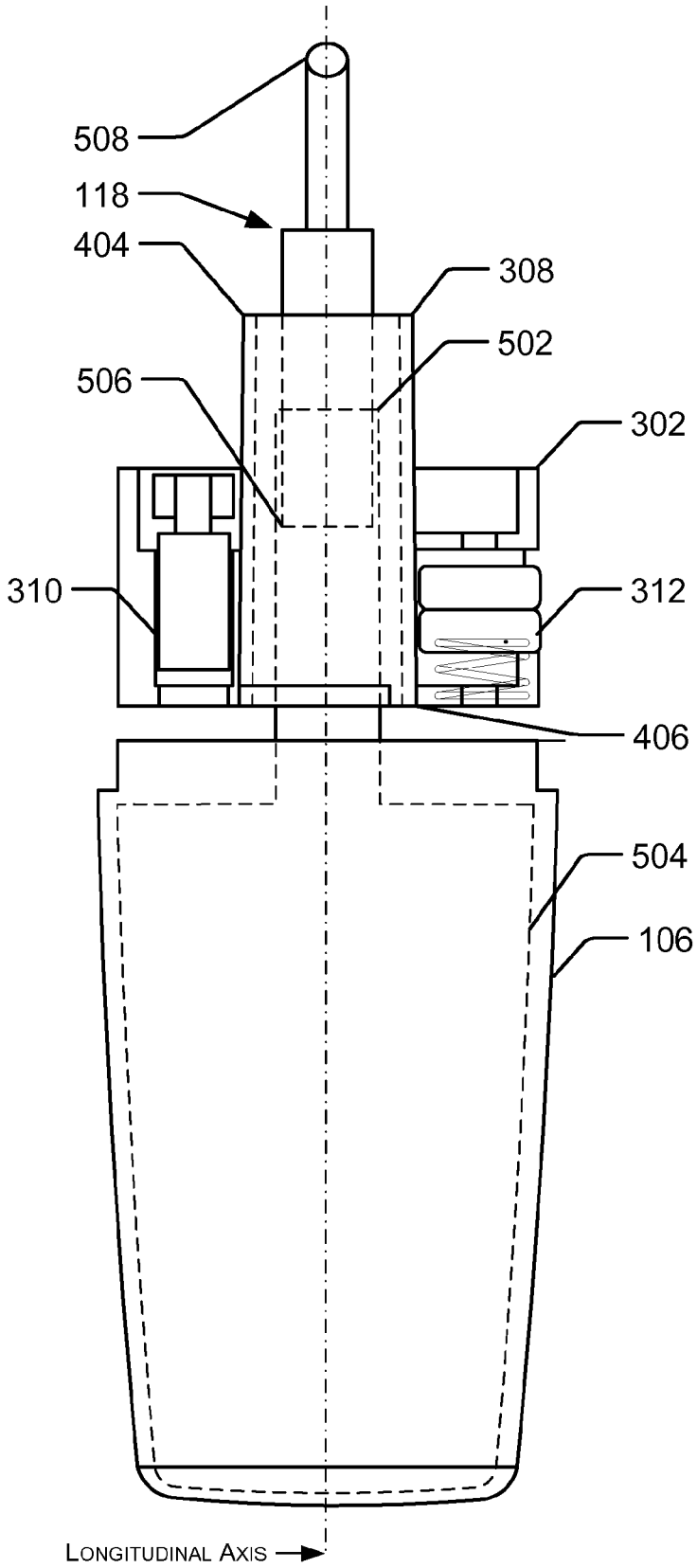
FIG. 5 illustrates plumbing interconnections in a front partial assembly view of the illustrative vibrating implement of FIG. 1.

Having now described vibrating mechanism 206, the discussion now turns to the plumbing within the vibrating implement 104, with reference to FIG. 5. FIG. 5 illustrates the plumbing interconnections in a front partial assembly view of the illustrative vibrating implement of FIG. 1. Again, longitudinal axis is illustrated to be disposed along vibrating implement 104. Beginning with housing 106, the plumbing interconnections may first comprise a delivery tube 502 interconnected to a reservoir 504 of housing 106. The delivery tube 502 longitudinally extending distally from the housing 106 along the longitudinal axis. While delivery tube 502 is illustrated here as being an extension of reservoir 504, tube 502 may alternatively be separate and distinct from reservoir 504. Further, tube 502 may be comprised of plastic, metal, ceramic or any other suitable material. For example, tube 502 may be comprised of terpolymer, polypropylene (PP), acrylonitrile butadiene styrene (ABS), Polyoxymethylene (POM) or any other suitable plastic material which is non-reactive or resistant to the product being dispensed.

Next, FIG. 5 illustrates delivery tube 502 penetrating and passing through the bottom coupling portion 406 of coupling 308. Further illustrated in FIG. 5, is tip insert 118 comprising a bottom portion 506 interconnected to delivery tube 502. Additionally, tip insert 118 is illustrated as comprising a top portion 508 longitudinally extending distally from the housing 106 along the longitudinal axis, and passing freely through the top coupling portion 404 of coupling 308. FIG. 5 further illustrates the first half 302 of floating chassis 306 freely disposed about the interconnection of the bottom portion 506 of tip insert 118 and delivery tube 502, which allows floating chassis 306 to float freely about the tip insert 118 and delivery tube 502. The tip insert 118 may be made of a thermoplastic polymer or any other material which is non-reactive or resistant to the product being dispensed, such as various metals, plastics, ceramics, composites, or the like.

Figure 6:
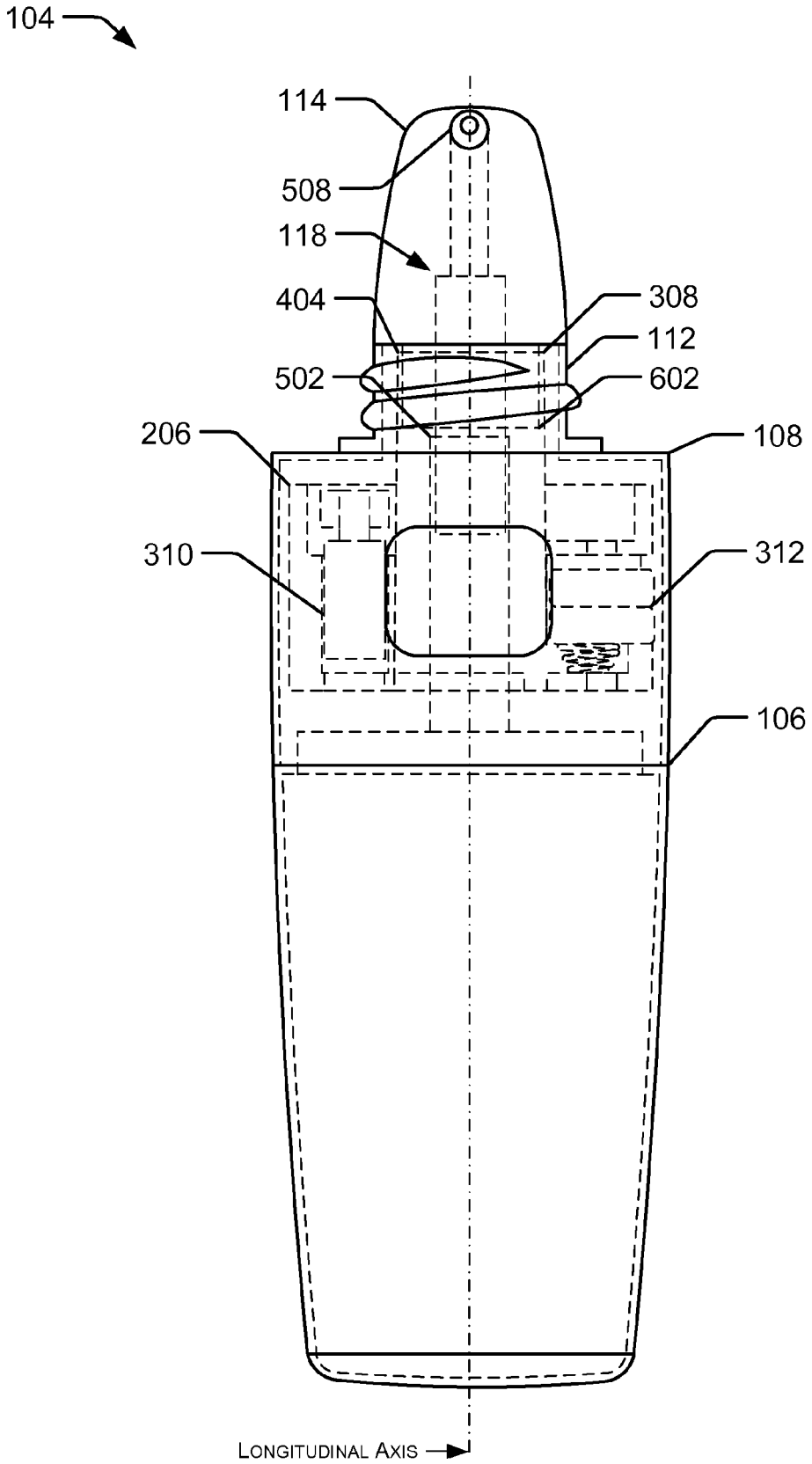
FIG. 6 depicts a detailed illustrative assembly in a front view of the illustrative vibrating implement of FIG. 1.

FIG. 6 depicts a detailed illustrative front view assembly of the vibrating implement 104 of FIG. 1. As discussed above with regard to FIG. 5, and illustrated here in FIG. 6, the plumbing interconnection comprises delivery tube 502 interconnected to tip insert 118 and vibrating mechanism 206 movably disposed about this pluming interconnection. Also, as discussed above, longitudinal axis is illustrated to be extending the length of the plumbing interconnections. Here, FIG. 6 further illustrates thermal storage tip 114 disposed proximate to vibrating mechanism 206. More specifically, FIG. 6 illustrates bottom portion 602 of thermal storage tip 114 being connected to top coupling portion 404 of coupling 308. Furthermore, FIG. 6 illustrates collar 108 movably containing the vibrating mechanism 206. Additionally, FIG. 6 further illustrates the interconnection of thermal storage tip 114 and top coupling portion 404 of coupling 308 being movably contained by protruding fastening portion 112 of collar 108. With thermal storage tip 114 directly coupled to coupling 308 the vibration produced by vibration generator 310, is transmitted to the thermal storage tip 114, with minimal vibration being transmitted to the user's hand. More specifically, with both the thermal storage tip 114 and the vibration generator 310 being directly attached to floating chassis 306. For example, the floating chassis may comprise an outer portion fixed to the collar and an inner portion fixed to the thermal storage tip. In that case, the inner portion may be loosely coupled to the outer portion, such that the inner portion remains movable relative to the outer portion. In this manner, the vibration produced by vibrating generator 310 is primarily transmitted through the floating chassis 306 to thermal storage tip 114 rather than to collar 108 or to housing 106.

Figure 7:
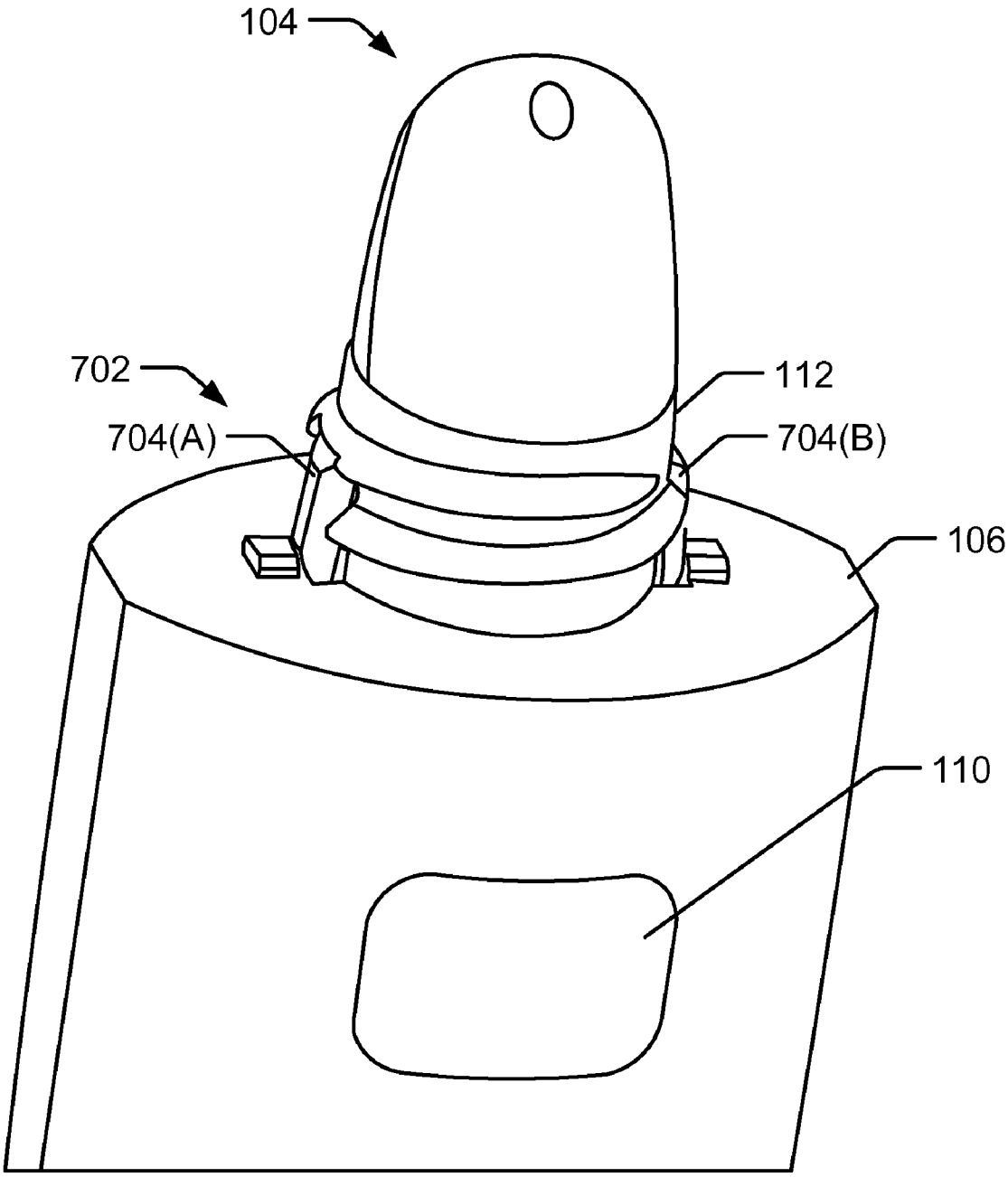
FIG. 7 depicts an illustrative cut-off switch disposed in the collar shown in FIG. 1.

While FIGS. 1 and 2 depict illustrative vibrating implements 104, each having the on/off push button switch 110 disposed in collar 108 for activating/deactivating the vibrating implement 104, FIG. 7 further illustrates, a cut-off switch 702 disposed in a surface of the protruding fastening portion 112 of the collar 108. The cut off switch 702 may be provided in addition to, or instead of, on/off switch 110. As illustrated in FIG. 7, cut-off switch 702 is disposed in a surface of the protruding fastening portion 112 with two rectangular bar shaped portions 704(A) and 704(B) protruding into a threaded portion of the protruding fastening portion 112. Here, the two rectangular bar shaped portions 704(A) and 704(B) are configured to be displaced in the direction of the center of collar 108 (i.e., in a latitudinal direction) when cap 122 is threaded onto the illustrated threads of protruding fastening portion 112. Furthermore, the cut-off switch 702 may be electrically coupled to the on/off switch 110, and configured to disable the on/off switch 110 when cap 122 is removably disposed on the protruding fastening portion 112 of the collar 108. Although, cut-off switch 702 is generally illustrated as two longitudinally protruding rectangular bars 704(A) and 704(B) that are configured to be displaced in a latitudinal direction, other switching means are contemplated. For example, by way of depressing a button or a ring longitudinally disposed on the top surface of the collar 108, or any other suitable switching means.

Alternative Illustrative Thermal Storage Tips

Figure 8A:
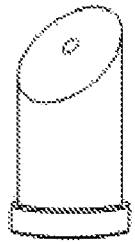
FIG. 8A-8C depict several illustrative shaped thermal storage tips usable with the implement of FIG. 1.
Figure 8B:
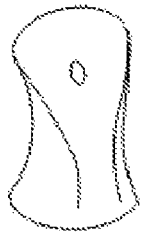
Figure 8C:
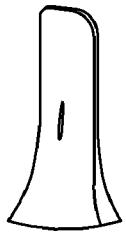

In the implementations shown in FIGS. 1-7, the thermal storage tip 114 comprises a conical body having a convex surface formed therein. However, in other implementations, thermal storage tip 114 may take any other desired form, such as generally curvilinear shape, a generally cylindrical shape, or a generally planar shape or combinations of the foregoing, or the like for providing multiple desired effects while applying product to a body. For example, FIGS. 8A-8C show several alternative shapes of thermal storage tip 114. Each of the thermal storage tips 114 shown in these implementations may include a housing 106 (not shown). In particular, any of the thermal storage tips 114 shown in these implementations (i.e., FIGS. 8A-8C) may be disposed proximate to a vibrating chassis (e.g., vibrating chassis 306). More specifically, any of the thermal storage tips 114 shown in these implementations (i.e., FIGS. 8A-8C) may be fixed to a top portion of a tip insert (e.g., tip insert 118). Further, a portion of the thermal storage tips 114 shown in these implementations may be connected to a top coupling portion of a coupling (e.g., coupling 308). While thermal storage tips may be connected to a coupling by way of an interference fit, other retaining mechanisms are contemplated. For example, crimping, adhesive, press-fit, snap-fit, or barbs on the inside of the coupling 308 and/or by any other suitable attachment means.

The thermal storage tips 114 may be coupled to the housing 106 in a similar fashion as discussed above. In particular, the thermal storage tips 114 shown in these implementations may be movably disposed on a fastening portion of a collar (e.g., collar 108) disposed on a housing (e.g., housing 106) comprising a flexible wall 120. Alternatively, any of the thermal storage tips 114 shown in these implementations (i.e., FIGS. 8A-8C) may be fixed to a housing comprising two flexible walls, one opposite another for dispensing a product.

Each illustrated shape of thermal storage tip 114 shown in FIGS. 8A-8C comprises a plumbing interconnection to a reservoir (e.g., reservoir 504). Likewise, as discussed above, thermal storage tip 114 may comprise a metal such as stainless steel, anodized aluminum, brass, a ceramic, a high-density plastic, or any other suitable material for conducting heat to a body. Finally, each of the illustrated thermal storage tips 114 may also comprise tip insert (e.g., tip insert 118) terminating in an application face.

CONCLUSION

Although embodiments have been described in language specific to structural features and/or methodological acts, it is to be understood that the disclosure is not necessarily limited to the specific features or acts described. Rather, the specific features and acts are disclosed as illustrative forms of implementing the embodiments. For example, in various embodiments, any of the structural features and/or methodological acts described herein may be rearranged, modified, or omitted entirely.

What is claimed is:

1. A vibrating implement for applying a product to a surface, the vibrating implement comprising:
- a housing comprising a reservoir for containing a product;
- a tip having an application face for applying product to a surface;
- a collar disposed between the housing and the tip; and
- a vibrating mechanism housed in the collar, the vibrating mechanism comprising a floating chassis movably disposed in the collar to apply vibration to the tip.

2. The vibrating implement according to claim 1, wherein the floating chassis comprises an outer portion fixed to the collar and an inner portion fixed to the tip, the inner portion being loosely coupled to the outer portion such that the inner portion remains movable relative to the outer portion.

3. The vibrating implement according to claim 2, further comprising:
- an electrically coupled motor and battery disposed on the inner portion of the floating chassis to apply vibration to the tip via the inner portion of the floating chassis; and
- an on/off switch disposed on the outer portion of the floating chassis so as to be fixed relative to the housing, the on/off switch being electrically coupled to the motor and battery.

4. The vibrating implement according to claim 1, wherein the tip comprises a thermal storage tip comprising a metal and/or a ceramic.

5. The vibrating implement according to claim 1, further comprising:
- a tip insert, the bottom portion of the tip insert being interconnected to a tube extending from the reservoir and the top portion of the tip insert being disposed in the tip.

6. The vibrating implement according to claim 5, wherein the floating chassis is loosely disposed about the interconnection of the tip insert and tube.

7. The vibrating implement according to claim 1, further comprising:
- a cap configured to be removably disposed on a protruding fastening portion of the collar, the cap for encapsulating the tip; and
- a cut-off switch disposed in a surface of the protruding fastening portion of the collar to disable the vibration mechanism when the cap is removably disposed on the protruding fastening portion of the collar.

8. The vibrating implement according to claim 1, wherein the housing is generally tube-shaped and comprises a flexible wall for forcing the product from the reservoir.

9. The vibrating implement according to claim 8, wherein the flexible wall comprises terpolymer.

10. The vibrating implement according to claim 1, wherein a center of the floating chassis is disposed closer to a center of the tip than to a center of the housing.

11. A vibrating implement for applying a product to a surface, the vibrating implement comprising:
- a housing comprising a reservoir for containing a product;
- a tip having an application face for applying product to a surface;
- a collar disposed between the housing and the tip; and
- a vibrating mechanism housed in the collar, the vibrating mechanism comprising:
  - a floating chassis movably disposed in the collar to apply vibration to the tip, the floating chassis comprising an outer portion fixed to the collar and an inner portion fixed to the tip, the inner portion being loosely coupled to the outer portion such that the inner portion remains movable relative to the outer portion;
  - an electrically coupled motor and battery disposed on the inner portion of the floating chassis to apply vibration to the tip via the inner portion of the floating chassis; and
  - an on/off switch disposed on the outer portion of the floating chassis so as to be fixed relative to the housing, the on/off switch being electrically coupled to the motor and battery.

12. The vibrating implement according to claim 11, wherein the tip comprises a thermal storage tip comprising a metal and/or a ceramic.

13. The vibrating implement according to claim 11, wherein a center of the floating chassis is disposed closer to a center of the tip than to a center of the housing.

14. The vibrating implement according to claim 11, further comprising:
- a cut-off switch disposed in a surface of a fastening portion of the collar and electrically coupled to the on/off switch, the cut-off switch being configured to disable the on/off switch when a cap is removably disposed on the fastening portion of the collar.

15. The vibrating implement according to claim 11, wherein the housing is generally tube-shaped and comprises a flexible wall for forcing the product from the reservoir.

16. The vibrating implement according to claim 15, wherein the flexible wall comprises terpolymer.

17. The vibrating implement according to claim 11, wherein the floating chassis is loosely disposed about the coupled tube and tip insert, such that the inner portion is configured to float in the collar.

18. A vibrating implement for applying a product to a surface, the vibrating implement comprising:

a housing comprising a reservoir and a tube interconnected to the reservoir;

a floating chassis comprising:

a first half sandwiched to a second half opposite the first half;

a coupling disposed in the first half and loosely disposed about the tube;

an electrically coupled motor and battery disposed proximate to an outside diameter of the coupling and sandwiched between the first half and the second half;

a collar disposed on a top portion the housing containing the floating chassis, the collar comprising a fastening portion extending from the housing and loosely disposed about the tube and the coupling;

an on/off switch disposed in a surface of the collar and received by the second half of the floating chassis, the on/off switch being electrically coupled to the motor and battery;

a cut-off switch disposed in a surface of the fastening portion of the collar and electrically coupled to the on/off switch, the cut-off switch for disabling the on/off switch;

a cap configured to activate the cut-off switch when the cap is removably disposed on the protruding fastening portion of the collar; and a thermal storage tip movably disposed on the fastening portion of the collar and coupled to the coupling opposite the housing.

19. The vibrating implement according to claim 18, further comprising:

a tip insert comprising a bottom portion coupled to the tube and a top portion coupled to the thermal storage tip.

20. The vibrating implement according claim 18, wherein the thermal storage tip comprises an application face for applying the product to a surface.

21. The vibrating implement according to claim 18, wherein the housing is generally tube-shaped and comprises a flexible wall for forcing the product from the reservoir.

22. The vibrating implement according to claim 21, wherein the flexible wall comprises terpolymer.

23. The vibrating implement according to claim 18, wherein the thermal storage tip comprises metal and/or ceramic.

* * * * *